United States Patent [19]

Scheidler et al.

[11] 4,453,533

[45] Jun. 12, 1984

[54] FRAME FOR PLATES OF GLASS, VITREOUS CERAMIC OR SIMILAR MATERIAL, PARTICULARLY FOR COOKER HOBS

[75] Inventors: Herwig Scheidler, Mainz-Finthen, Fed. Rep. of Germany; Günther Keller, Vols/Innsbruck, Austria

[73] Assignee: Schott Glaswerke, Mainz, Fed. Rep. of Germany

[21] Appl. No.: 346,354

[22] Filed: Feb. 5, 1982

[30] Foreign Application Priority Data

Feb. 6, 1981 [DE] Fed. Rep. of Germany ..... 3104114

[51] Int. Cl.[3] ..... F24C 15/10; H05B 3/68

[52] U.S. Cl. ..... 126/211; 219/464

[58] Field of Search ..... 126/211, 214, 39 H; 52/400, 475, 482, 489, 716, 717; 219/464, 463, 459, 345

[56] References Cited

U.S. PATENT DOCUMENTS 2,456,175 12/1948 Coppock et al. ..... 52/400

2,793,071 5/1951 Meyer ..... 126/214 A 4,243,016 1/1981 Kristen ..... 126/39 H

FOREIGN PATENT DOCUMENTS 238427 5/1962 Fed. Rep. of Germany ..... 52/400

*Primary Examiner*—James C. Yeung

*Assistant Examiner*—G. Anderson

*Attorney, Agent, or Firm*—Pollock, Vande Sande & Priddy

[57] ABSTRACT

The new frame which is designed for use as a surround for plates (1), particularly for cooker hob plates, consists of two frame profiles of matched, or mutually coordinated profile configuration, namely of a mounting frame (2*a*) which is permanently bonded to the plate, and a sealing frame (6*a*) which, on the one side, is detachably (7) connected to the mounting frame and, on the other side, is pressed against the plate by means of a permanently elastic adhesive (3,5) or by a rubber sealing profile, as shown by way of example in FIG. 2.

1 Claim, 16 Drawing Figures

FIG. 1b
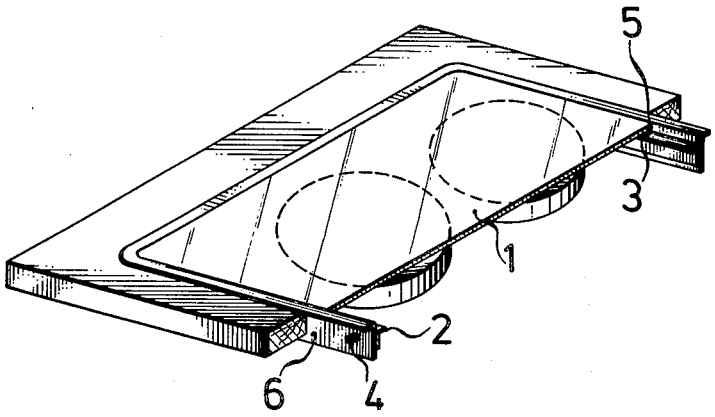
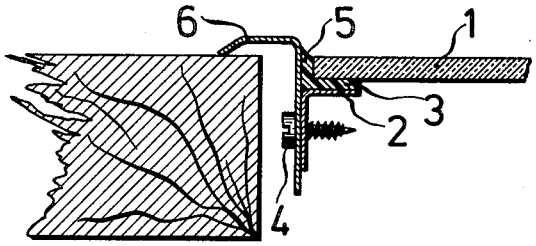
FIG. 1

FRAME FOR PLATES OF GLASS, VITREOUS CERAMIC OR SIMILAR MATERIAL, PARTICULARLY FOR COOKER HOBS

DESCRIPTION

Cooker hobs with vitreous ceramic hob plates have already acquired a large share of the market. Particularly well received in the market are such hobs in which the hob plate is bonded by a thermo-stable, permanently elastic adhesive to a continuous surrounding frame, as described, for example, in German OS 28 19 118, and German OS 30 09 961.

The vast majority of adhesively bonded hob plates of this kind are provided with frames made of alloy steel profiles. However, in recent times there has been an increasing customer demand for hob panels with coloured frames. Apart from special purpose designs, e.g. specifying copper strip or the like, enamelled, plastic-coated or lacquered sheet metal sections have been primarily used for making such coloured hob-plate frames.

In practice, however, it was found that coloured hob frames of this type tend to create problems—both in manufacture and in use—due to the fact that they are relatively vulnerable to damage caused by scratching and/or denting and where such damage has lead to larger surface scratches or surface-flaking, repair work is either highly unsatisfactory or impossible.

This disadvantage is felt particularly if a damaged hob frame has to be wholly replaced because frame replacement necessarily also entails the replacement of the hob panel permanently bonded thereto and this is very expensive. Alloy steel frames do not have this particular drawback because in most cases local frame damage can be quite easily repaired without having to remove the frame from the hob plate.

Production problems also arise, especially with frames which are provided with special surface coatings, from the fact that certain solvents or cleaning agents which must be applied in the course of production, for example for degreasing the frame sections prior to adhesive bonding, are chemically aggressive in regard to such surface coatings and this may adversely affect the final appearance and durability of the surface coating on the frame sections.

On the other hand, given the situation that it is basically possible to provide hob plates with coloured frame surrounds, there is an ever increasing demand in the market for maximum flexibility in the choice of hob frames and this creates quite considerable cost- and stock-holding-problems for the cooker hob manufacturers.

The present invention therefore aims to combine the very real advantages resulting from the adhesive bonding of the hob plates to continuously surrounding frames with a large degree of flexibility in regard to choice of material and colour for the hob plate frames while avoiding the above described disadvantages hitherto encountered in production and service.

This aim is achieved in a frame according to the claims.

The advantages of the frame construction according to the present invention by comparison with the prior art are particularly apparent if, prior to the adhesive bonding between frames and hob plates, a suitable parting medium (for example talcum powder or wax polish) is applied to the sealing frame. In that case, the adhesive joint will still provide a good seal between hob plate and sealing frame, but will not form a durable bond so that the sealing frame can be readily detached from the hob plate by releasing the connecting—or securing-means (screws, catches, springs or the like) which are provided between sealing—and mounting frames.

Relative separability of hob plate and frame without major problems can also be achieved if the sealing frame is initially used as a gauge, or template in the adhesive bonding process, (the frame being made, for example, of Teflon because this material is not wettable by silicone adhesives). After 'setting' of the adhesive in this template the hob plate is taken out of the template complete with a silicon-rubber edge which has been quasi vulcanized onto it and—according to the prior art—with the mounting frame adhesively bonded thereto, and then the sealing frame—which must have the same interior contour as the template, preferably a few 1/10 mm smaller—is pushed into place and secured to the mounting frame by means of suitable co-acting securing elements. The subsequent exchange of an old frame for a new one, and/or for a frame of a different colour, and/or for a different sealing frame profile, will then present no problems whatsoever.

However, even if the sealing frame is adhesively bonded to the hob plate it can still be comparatively easily separated therefrom because the sealing gap between hob plate and sealing frame can be easily cut open or slit from the top side, for example with a razor blade. Then, after the securing means between sealing—and mounting frames habe been released, the sealing frame can be readily separated from the hob plate by pulling it up or down—depending on the given constructional design, away from the mounting frame and thus from the hob plate itself.

Thanks to this simple principle damaged frames can be easily replaced with new ones, and optionally frames of different colours and/or with different profiles may be combined with the same hob plates and mounting frames.

In order to ensure a good fit between mounting—and sealing frames it is advisable to fabricate at least the sealing frame in a deep—drawing tool or the like. The mounting frame should preferably be received in a template during the adhesive bonding operation.

The invention is hereinafter more particularly described with reference to the accompanying drawings which illustrate preferred embodiments. It will be appreciated that the invention is not confined to those examples and that it is equally applicable not only to the framing of hob plates but also to the framing of other plates or panels of glass, vitreous ceramic or similar material.

DESCRIPTION OF THE DRAWINGS

FIG. 1 is a profile view of the cooker hob plate frame of this invention in profile.

FIG. 1*a* is a perspective view of the invention.

EXAMPLE 1 (FIG. 1)

Figure 2:
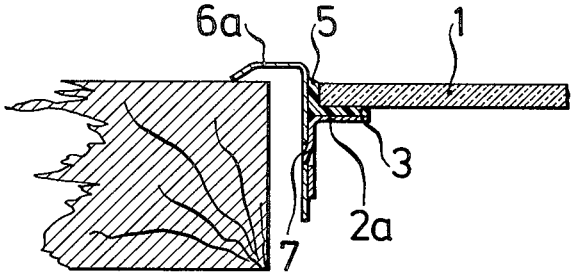
FIGS. 2–14 are profile views of alternative embodiments of the invention.

The mounting frame (2) has the configuration of a simple angle- or U-section with an outside measurement which is about 3 mm larger than the outside measurement of the hob plate (1). The sealing frame (6) has the profile shown in FIG. 1, its inside measurement corresponding to the outside measurement of the mounting frame with appropriate (+)-tolerance. Both frame parts are mutually connected by means of screws (4), the vertical profile limbs of the mounting frame—and preferably also of the sealing frame, having round or polygonal holes for the fixing of supporting struts designed to support the heating elements, the base plate or like parts.

The hob plate is adhesively fixed into these two-part frames at 3,5 in the same way as it would conventionally be fixed in a one-part frame. If necessary, the sealing frame can be detached without problem from the mounting frame, and thus from the hob plate, by releasing the screws and, if necessary, slitting the vertical adhesive joint gap (5).

EXAMPLE 2 (FIG. 2)

In this embodiment of the invention the sealing frame (6*a*) corresponds to that shown in example 1, the only difference residing in that instead of round holes for a screw connection it comprises polygonal-preferably transverse non square holes, which receive connection lugs and spring catches (7) that project from the mounting frame (2*a*). This provides a secure frame connection without the additional provision of screws, which can however be easily released simply by pressing back the lugs and/or spring catches.

Except for the projecting spring catches and lugs, the mounting frame (2*a*) in this embodiment of the invention is identical with example 1.

Naturally, the spring catches and lugs may also be arranged on the sealing frame while the corresponding polygonal holes would then be provided in the mounting frame.

Figure 15:
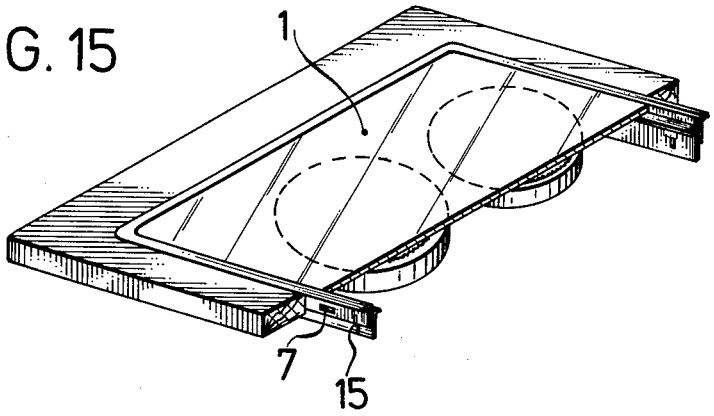
FIG. 15 is yet another perspective view of the invention as embodied by FIG. 14.
Figure 14:
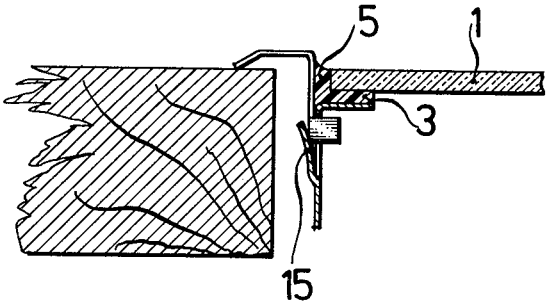

Any risk of lateral displacement of the depending limb of the sealing frame may be precluded by the provision of upwardly directed open clip elements (15) on the mounting frame (FIGS. 14,15).

EXAMPLE 3 (FIG. 3)

The mounting frame (2*a*) of example 3 is identical with that of example 2 as far as its upper part is concerned. However, this particular "frame" is an integral part of a trough provided with openings (9) in the region of the bottom (10) for the accommodation of the heater elements.

Figure 3:
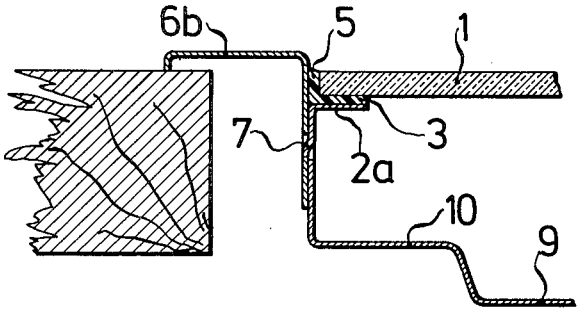
Figure 4:
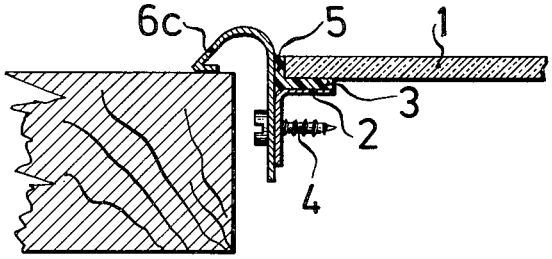
Figure 5:
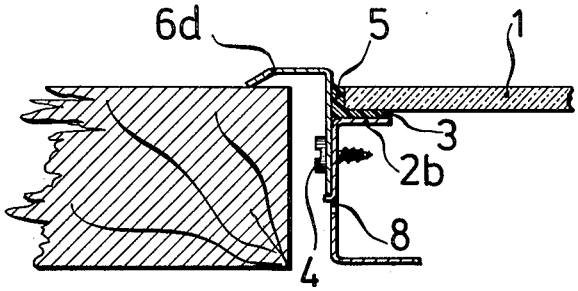

The profile of sealing frame (6*b*) corresponds to FIG. 3 but the holes for the spring catches and lugs (7) of the mounting frame are arranged in identical positions to those shown in the sealing frame (6*a*) according to example 2.

The use of the sealing frame (6*b*) with a wide visible, horizontal limb instead of the sealing frame (6*a*) is advantageous if a relatively wide gap has to be bridged between the worktop cut-out and an undersized hob-plate.

EXAMPLE 4 (FIG. 4)

The mounting frame (2) of this example is identical with that of example 1.

However, the sealing frame has a different visible profile. As in the case of example 1, this sealing frame (6*c*) can be easily exchanged for a new frame simply by unscrewing the screws (4).

EXAMPLE 5 (FIG. 5)

This example illustrates two further embodiments of the sealing frame (6*d*) and the mounting frame (2*b*). Again both frame parts are mutually detachably connected by means of screws (4). The characteristic feature of this particular embodiment resides in that the sealing frame (6*d*) can be pushed right up to an "end stop" (8) formed in the mounting frame (2) which enables it to be virtually precision-fitted.

EXAMPLE 6 (FIG. 6)

This example illustrates a different profile form for sealing frame (6*e*) and mounting frame (2*c*). As in example 3, the "frame 2*c*" shown here is an integral part of a trough with bottom region (10) and openings for the heater elements. The durable but easily detachable connection between mounting-and sealing frames is obtained due to the fact that the lower region (6*e*') of the sealing frame is capable of a slight amount of elastic movement and adapted to be fixed by nubs (11) on the mounting frame when it has snapped over nubs (11) With this kind of profile of sealing—and mounting frames, the seal between sealing frame (6*e*) and mounting frame (2*c*) and thus the seal for the whole frame unit is conveniently provided by a circumferentially continuous rubber profile (12), preferably a hollow profile and, where applicable, provided with additional sealing lips. Due to matching profile configurations such a rubber profile (12) (see also FIG. 11) will be compressed between the horizontallimbs (6*e*,2*c*) of sealing- and mounting frames (6*e*,2*c*) and thus firmly fixed in position.

EXAMPLE 7 (FIG. 7)

In this example the sealing frame (6*f*) is formed as the exterior surround or housing of a table-top appliance. The same arrangement is possible for the top part of a free-standing cooker. The mounting frame (2*d*) is similar—except for the nubs—to that shown in example 6, merely with the difference that it is not closed in the bottom region, that is to say, that it does not form a trough.

Again sealing-and mounting frames are mutually connected by screws (4).

EXAMPLES 8 to 13 (FIGS. 8 to 13)

Further examples are illustrated in FIGS. 8 to 13.

Figure 8:
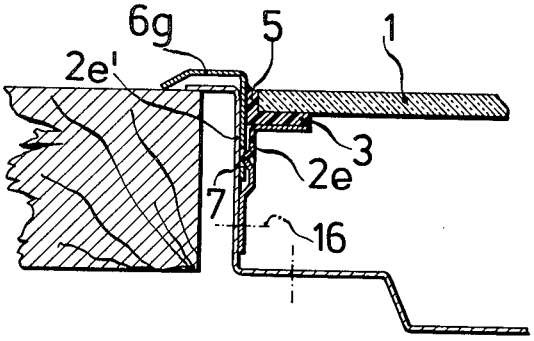

According to FIG. 8, the sealing frame (6*g*) is formed as a decorative frame which is securely held between two vertical legs of the mounting frame which are mutually rigidly connected in the lower region (16) and elastic in the upper part (2*e*'), the sealing frame being located by cams (7) on the mounting frame.

Figure 9:
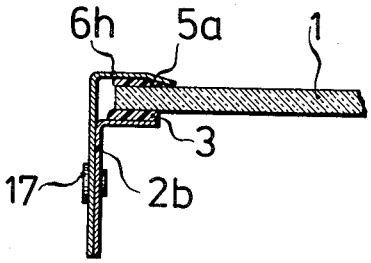

According to FIG. 9, the sealing frame profile (6*h*) in this embodiment of the invention overlaps the hob plate and is sealed relative to the latter by the seal (5*a*) while being connected to the mounting frame (2*b*) by means of rivets (17).

Figure 6:
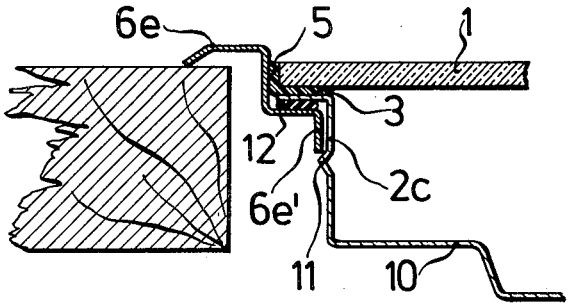
Figure 7:
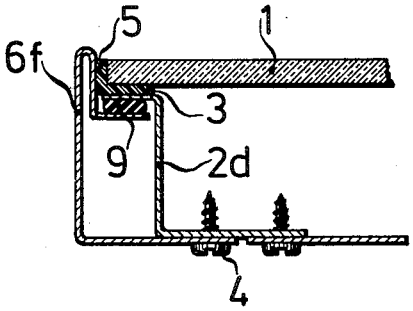
Figure 10:
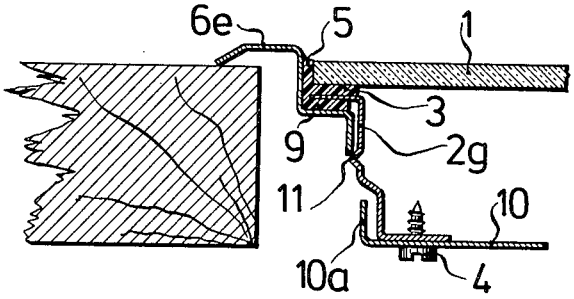

Example 10, shown in FIG. 10, is similar to that shown in FIG. 6, only here the mounting frame profile (2*g*) is of such a configuration that the overlapping marginal flange (10*a*') of the base plate (10) is adapted to be secured to the mounting frame by means of screws (4).

Figure 11:
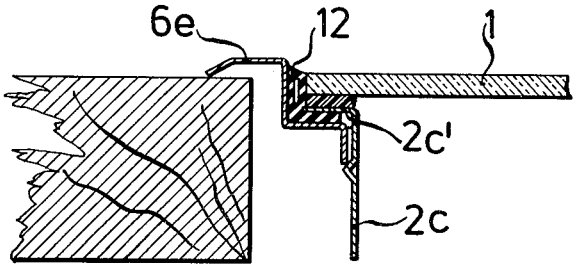

In example 11, according to FIG. 11, the sealing- and mounting frames are similar to example 6, but in this example the seal between hob plate and sealing frame, on the one hand, and between mounting frame and sealing frame on the other, is obtained by means of a common, peripherally closed rubber profile (12).

Figure 12:
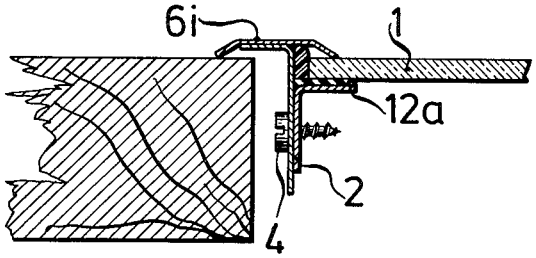

In example 12, the sealing frame has the profile configuration shown at (6*i*) in FIG. 12 and slightly overlaps the topside of the hob plate 1. Otherwise the connection between sealing—and mounting frame (2) is made as in FIG. 1 by means of screws (4). The seal between sealing frame and hob plate is provided by a rubber profile 12*a*.

This embodiment may be adopted with special advantage if the top edge of the hob plate is chipped or otherwise slightly damaged and this is to be concealed by an overlapping frame.

Figure 13:
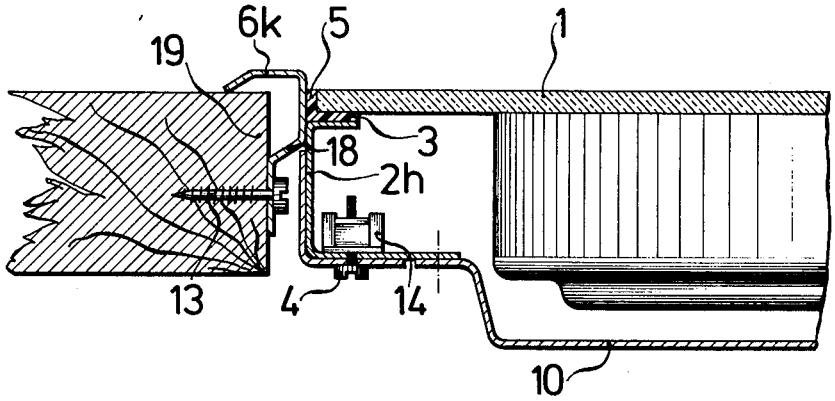

In example 13 according to FIG. 13 certain regions (18) of the sealing frame profile (6*k*) have been pushed out, or raised, for securing the sealing frame by means of screws (13) in the cut-out (19) of a wooden worktop.

This kind of sealing frame is connected by a special screw connection (14,4) to the mounting frame (2*h*) to which latter the hob plate (1) has been bonded by means of an adhesive (3). In this case, the sealing frame may remain firmly fixed in the worktop cut-out while the hob plate, the mounting frame and the base tray (10) are taken out. The special screw connection enables hob plate adjustment to a pre-selected level during re-fitting in the frame.

We claim:

1. A mounting system for a glass plate or the like, the system comprising:

a mounting frame attached to the periphery of an underside of the plate;

a sealing frame removably fastened to the mounting frame and adapted to support the mounted plate in substantially coplanar relation with an adjacent counter surface;

a continuous elastic member having a first section thereof positioned between the sealing frame and a confronting edge of the plate for creating a seal therebetween, a second section of the elastic member permanently bonded between the mounting frame and the periphery of the plate underside; and means for unfastening the sealing and mounting frames thus permitting disengagement therebetween and removal of the sealing frame without damage to the elastic member.

* * * * *